US005855204A

United States Patent [19]

Gray et al.

[11] Patent Number: 5,855,204

[45] Date of Patent: Jan. 5, 1999

[54] MULTI-LAYER MOP

[76] Inventors: Ronald Gray, 720 Grandview Dr., Sequim, Wash. 98382; Robert Palmer, 11825 E. 168th St., Artesia, Calif. 90706

[21] Appl. No.: 557,129

[22] PCT Filed: Jun. 8, 1995

[86] PCT No.: PCT/US95/07366

§ 371 Date: Jun. 18, 1996

§ 102(e) Date: Jun. 18, 1996

[87] PCT Pub. No.: WO96/41564

PCT Pub. Date: Dec. 27, 1996

[51] Int. Cl.[6] ..... A47L 13/20

[52] U.S. Cl. ..... 15/228; 15/147.1; 15/226

[58] Field of Search ..... 15/147.1, 147.2, 15/226, 223, 228, 229.1, 229.2, 229.6

[56] References Cited

U.S. PATENT DOCUMENTS

| | | | |
|---|---|---|---|
| 3,081,476 | 3/1963 | Mosheim | 15/226 |
| 3,204,277 | 9/1965 | Visman | 15/223 |
| 4,114,224 | 9/1978 | Disko | 15/226 |
| 4,190,921 | 3/1980 | Rose | 15/228 |
| 4,995,133 | 2/1991 | Newell | 15/228 |
| 5,199,130 | 4/1993 | Lazar | 15/147.1 |

*Primary Examiner*—Randall Chin

*Attorney, Agent, or Firm*—Gene Scott-Patent Law & Venture Group

[57] ABSTRACT

An apparatus is provided for cleaning a surface [5], the apparatus including a plurality of water absorbing flexible washing layers [10] positioned and secured in a vertical stack [20]. The bottom layer [30] in the stack [20] has the smallest surface area of the plurality of layers [10], and each successive layer [10] from the bottom to the top of the stack has a successively larger area. A binding means [80] secures the layers [10] together at a central portion [15], thus forming an integral assembly in which peripheral portions [18] of the layers [10] can move freely. The layers [10] are constructed of a material formulation of approximately 30% viscose material and 70% synthetic fiber in a density of approximately 400 grams per square meter and a thickness of approximately 2.6 mm. Each layer [10] preferably has a plurality of cuts [40] that define fingers [50] on the peripheral portion [18] of the layers [10].

11 Claims, 3 Drawing Sheets

MULTI-LAYER MOP

FIELD OF THE INVENTION

This invention relates generally to mop devices, and, more particularly, to an improved mop device with multiple layers each having multiple cleaning fingers, and constructed of approximately 30% viscose and 70% synthetic fiber.

BACKGROUND OF THE INVENTION

A wide variety of mops are known in the prior art, such mops generally having a single sponge-like absorptive element or a bundle of absorptive fibers for holding water and cleaning solutions in cleaning applications. Sponge mops, while typically well-suited for such applications, tend to have less scrubbing efficiency than do mops with fiber bundles which can reach into small openings and such, as well as hold more solution on a weight to weight basis. Moreover, sponge-like materials tend to snag on surface irregularities, becoming damaged. As such, sponge mops are less effective in applications where considerable cleansing force is required, such as in washing a vehicle surface. In such an applications, water holding capacity of the mop is only important in so far as delivering soapy water to the surface. Once the soapy water has been delivered, the cleansing and scrubbing capacity of the mop becomes more important than the mop's ability to remove liquid from the surface.

Well known mops-comprising fiber bundles or strings are in common use. These tend to droop and bunch together when soaked in water, resulting in a relatively small and uneven portion of the fibers contacting the work surface. While a certain amount of unevenness is desirable between the mop and the surface to obtain an effective scrubbing action, such bunched together fibers or strings have a small effective sweeping width so that many strokes of such a mop must be used to clean the surface adequately, making such a mop more difficult and time consuming to use. Moreover, such mops tend to have rigid mop head structures, typically made of metal, that can damage the surface to be cleaned whenever inadvertent contact is made. Further, such mops tend to include hardware assemblies for wringing water out of the mop. Such hardware is unnecessary and undesirable when washing a vehicle since the vehicle is usually rinsed with a hose and towel dried and contact with metal portions of the mop tend to scratch the surface.

Unlike fiber-bundle mops, mops composed of strips of felt-like material do not tend to bunch together during moping. However, such strips do tend to droop when soaked in water, which, as with the fiber string mops, can result in a problem with bunching. As such, even though such felt strips are effective scrubbing implements, the effectiveness of this type of mop for cleaning vehicles and the like may be inefficient and problematic.

Mops with multiple layers and multiple cleaning fingers have been created to remedy these problems. Such mops have a relatively large sweep width and allow for effective scrubbing action suitable for cleaning the surface of a vehicle. Examples of such mops are seen in Brockmeier et al. U.S. Pat. No. 2,779,044, Rose U.S. Pat. No. 4,190,921 and Visman et. al. U.S. Pat. No. 3,204,277. Unfortunately, while the structure of these prior art mops may be advantageous for cleaning vehicles and other such large surface area applications, their effectiveness is significantly limited by the materials of which they are constructed. As disclosed, Brockmeier's mop device is constructed of heavy cotton drilling, unbleached muslin, cotton outing flannel or other such soft fabrics, Rose's device is constructed of a combination of material with a high coefficient of friction and a synthetic loose-weave net material, and Vishman is constructed out of a highly resilient and compressible artificial sponge-foam such as regenerated cellulose sponge. While these materials may serve the intended cleaning functions of the devices, they do not provide the necessary softness, resiliency, flexibility, durability, scratch resistance, and high water absorption and retention needed for effectively and uniformly cleaning the critical painted surfaces of vehicles.

Thus there is a clear need for an improved mop device suitable for thoroughly cleaning the surface of a vehicle. Such a needed device would have an multi-layered structure with each of the layers secured in the center portion and multiple cleaning fingers extending outwardly. The mop would be constructed of a material formulation providing the proper thickness, tensile strength, weight and absorption needed for the intended use of the device. The present invention fulfills these needs and provides further related advantages.

SUMMARY OF THE INVENTION

The present invention is an apparatus for cleaning a surface, such as the surface of a vehicle. A plurality of water absorbing flexible washing layers with a central and a peripheral portion are positioned in a vertical stack so that the central portion of the layers are aligned with one another. The bottom layer in the stack has the smallest surface area of the plurality of layers, and each successive layer from the bottom to the top of the stack has a successively larger size.

As a key inventive feature of the present apparatus, the layers are constructed of preferably, approximately 30% viscose material and 70% synthetic fibers in a density of 400 grams per square meter and a thickness of preferably approximately 2.6 mm. These two materials are bound together so that the fibers are totally interconnected with each other so as to provide a mop with increased water absorption and improved resistance to tearing. The inventive material has an ultra-soft surface so that it does not scratch or otherwise damage a vehicle's surface, and yet it provides the surface roughness necessary to remove debris from the surface and hold particles within the mop. Thus, it is a primary object of the present invention to provide a mop device constructed of a material formulation that provides working qualities of unique value that are far superior to those of the prior art devices for cleaning painted vehicle surfaces.

Each layer has a plurality of cuts that define fingers on the peripheral portion of each one of the layers. Each cut of each layer is preferably positioned at the center of each of the fingers on the immediately adjacent layers. In use, the peripheral portion of each of the layers moves downwardly so that the fingers of each layer are in contact with the surface to-be cleaned. Thus it is an object of the present invention to provide a mopping device that is configured to have a relatively large sweep width and a alternate staggered finger arrangement such that the fingers of each immediate upper layer support the fingers of each immediate lower layer to provide effective scrubbing action by assuring that all of the fingers are in contact with the surface to be cleaned.

The apparatus includes a means for binding the layers together at the central portion of the layers so that the layers are maintained in the stack. The apparatus may include a cap with a surface for contacting the top layer to provide rigidity to the stack of layers, and a covering means for covering at least one portion of the cap to prevent the cap from contacting the surface being cleaned. The cap further preferably includes an integral handle extending above the stack so that the apparatus may be manipulated for washing the surface.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the invention. In such drawings.

DETAILED DESCRIPTION OF THE PREFERRED EMBODIMENT

Figure 1:
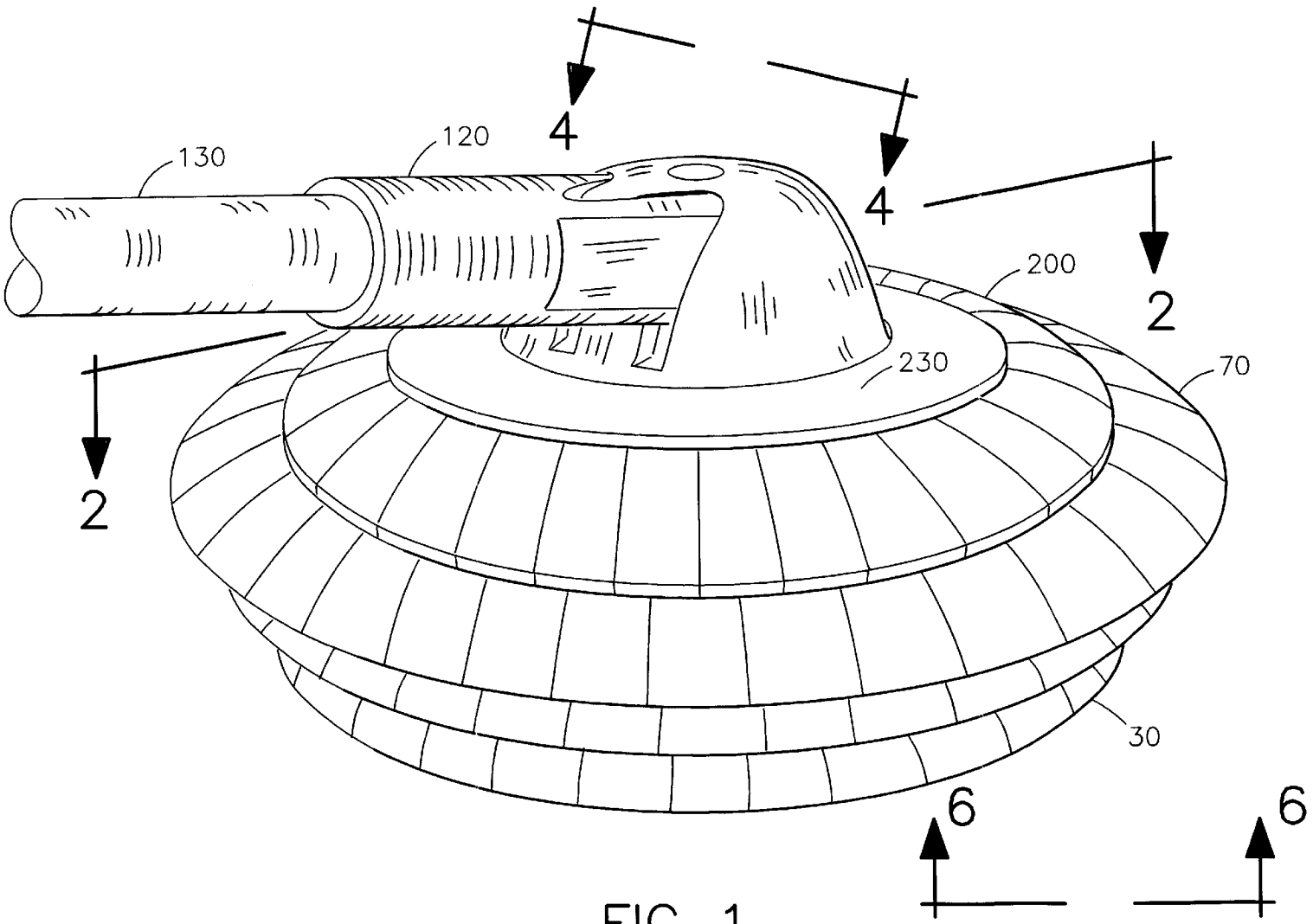
FIG. 1 is a partial perspective illustration of the invention, illustrating water absorbing layers with fingers defined therein.

FIGS. 1–6 show an apparatus for cleaning a surface 5. The apparatus includes a plurality of water absorbing flexible washing layers 10 that are positioned in a vertical stack 20. The bottom layer 30 in the stack 20 has the smallest surface area of the plurality of layers 10, and each successive layer 10 from the bottom to the top of the stack 20 has a successively larger area. Each of the layers has a central portion 15, which is positioned generally at the center of the layer's surface area, and a peripheral portion 18, which constitutes the peripheral remainder of each layer. The present inventive apparatus also includes a binding means 80 for retaining the layers 10 in the stack 20, thus forming an integral assembly. As illustrated, the binding means 80 is positioned so as to secure the layers 10 at their central portions 15 so that the peripheral portions 18 of each layer 10 can move independently and most freely.

The layers 10 are constructed of a combination of approximately 30% viscose material and 70% synthetic fiber in a density of approximately 400 grams per square meter and a thickness of approximately 2.6 mm. The ratio of the material of construction as well as the thickness of each layer may both vary by up to, plus or minus, 25%. The synthetic fiber is composed of polyester, polypropylene or polyethylene fibers, or any combination of these materials.

These specifications have proven, through extensive studies, to provide the best compromise in flexibility, resilience, tear resistance and water absorption so as to provide a superior mop having working qualities of unique value. Other material combinations and specifications have been tested but the present inventive formulation has consistently demonstrated significantly superior performance and durability.

When the formulation is altered beyond the preferred range of 30% viscose and 70% synthetic fibers, ±25%, the material either becomes too stiff, and thus incapable of a flexibility necessary for reaching all of the intricate contours of the surface 5, or it becomes too fragile, and thus susceptible to rapid deterioration. With the preferred specifications, the material provides a wet and dry tensile strength, as per DIN standard 53 857, of 450N longitudinally and 500N crosswise. As per DIN standard 53 923, the material's water absorption is 550%, and its absorption rate is 45 mm in 30 seconds, 55 mm in 60 seconds and 65 mm in 120 seconds, as per DIN standard 53 924. In addition, the preferred material formulation has a bending stiffness of 1,000 N.

There are numerous possible embodiments for the structure of the mop apparatus. In one preferred embodiment, illustrated in the figures, each layer 10 of material has a plurality of cuts 40 which sever the peripheral portion 18 of the layer 10 and extend from the outer edge to the central portion 15 of the layer. The cuts 40 define fingers 50 on the peripheral portion 18 of each one of the layers 10. Each cut 40 of each layer 10 is preferably positioned at the center of each of the fingers 50 on the immediately adjacent layers 10 (FIG. 6), thus staggering the positioning of the fingers 50 so that each finger of each layer above a given lower layer presses downwardly upon two of the fingers in the lower layer thereby supporting the lower fingers. Since the layers are secured at the central portion 15, when the mop assembly is shaken the fingers 50 can move freely in a waving or flopping motion. This movement provides for more thorough cleaning, as the fingers 50 can be thrusted into the various niches, nooks and crannies on a vehicle such as for cleaning the grill, lights and so on.

Figure 2:
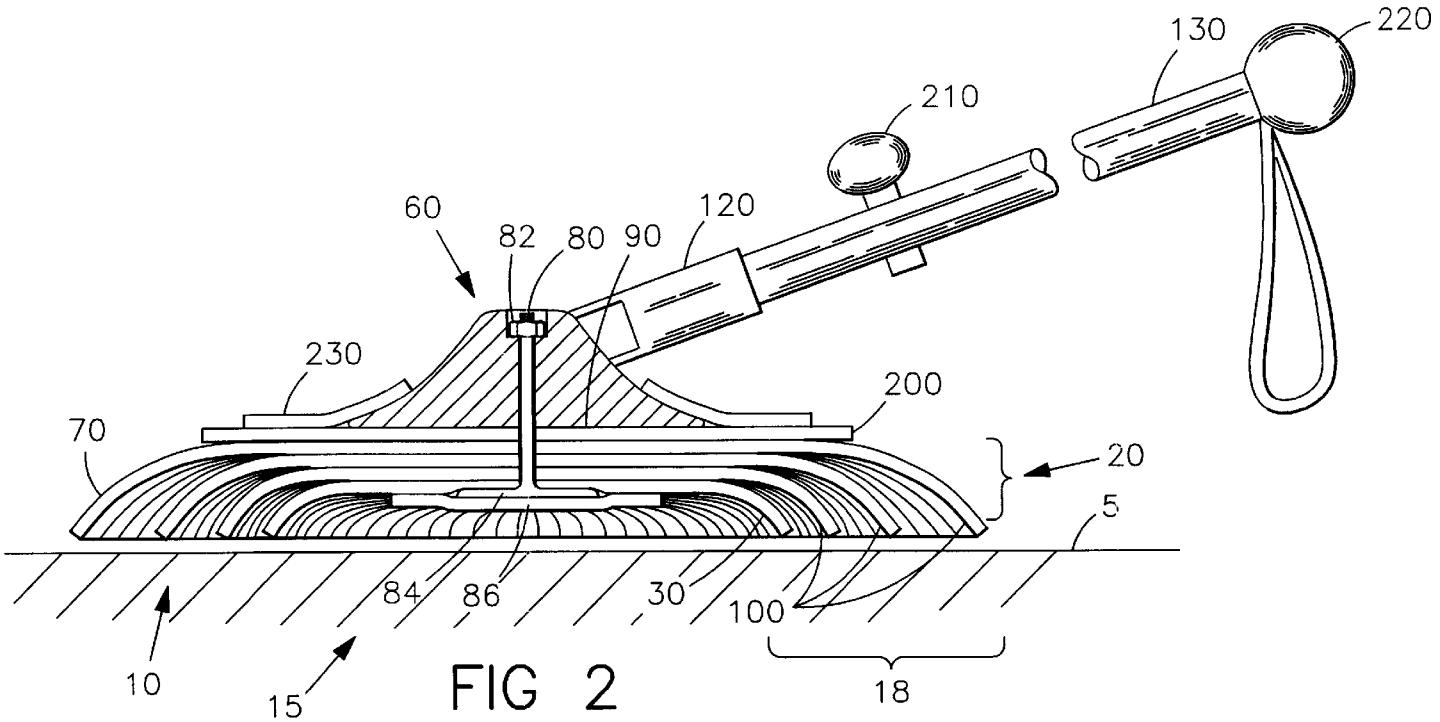
FIG. 2 is across sectional view of the invention, taken generally along lines 2—2 of FIG. 1.
Figure 3:
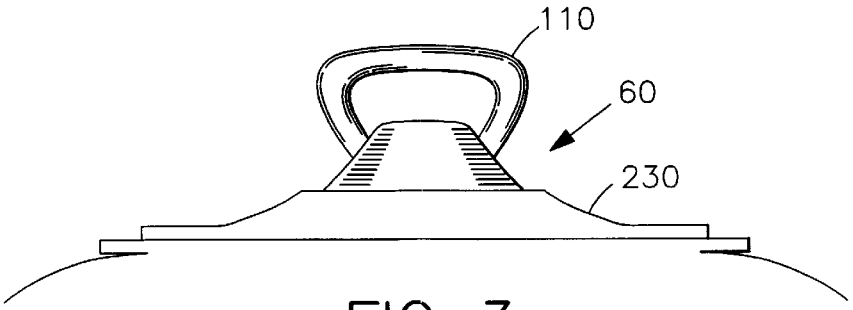
FIG. 3 is a partial side elevational view of the invention, illustrating a cap of the invention with an integral handle therein.

The preferred embodiment also includes a cap 60 mounted above the top disk 70 of the stack 20 of disks 10. The binding means 80 preferably made of a rigid metal or plastic, comprises a rigid retaining disk and rod 84 and is secured to the cap 60 with a nut 82. A protective cover disk 86, made of the same material as the layers 10, covers the retaining disk portion of the disk and rod 84, preventing the retaining disk from contacting, and possibly scratching the surface 5 (FIG. 2). The cap 60 further includes a flat surface 90 for providing rigidity to the stack 20 of disks 10, the stack 20 being squeezed between the disk-shaped surface 90 and the retaining disk of the disk, and rod 84. The cap 60 preferably further includes a partial covering means 230 of a soft material, for at least partially covering the cap 60 to prevent the cap 60 from scratching portions of the vehicle which may tend to come into contact with the upper surfaces of the invention during cleaning operations.

Figure 4:
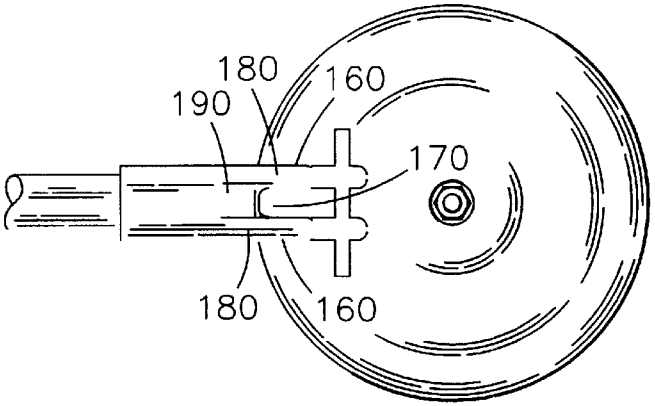
FIG. 4 is a partial top plan view of the invention, illustrating an alternate handle means attached to the cap of the invention.
Figure 5:
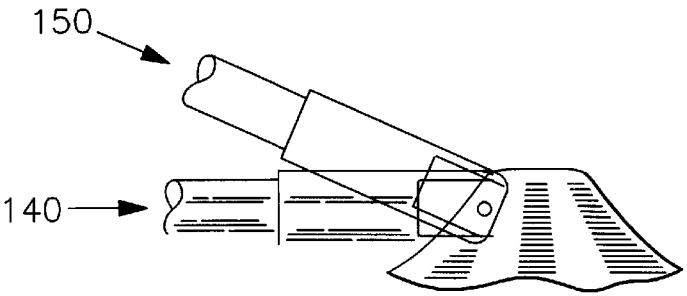
FIG. 5 is a partial side elevational view of the invention, illustrating two possible positions of the handle of FIG. 4.
Figure 6:
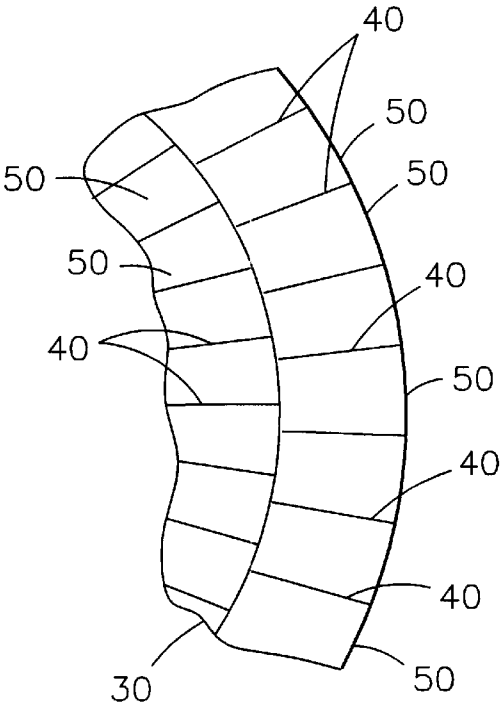
FIG. 6 is a partial cross sectional view of the invention, taken generally along lines 6—6 of FIG. 1, and illustrating relative positioning of fingers of adjacent layers of the invention.

The mop device further preferably includes a handle attachment means 120 and an elongated handle 130. The handle 130 is engagable with the handle attachment means 120 so that the apparatus may be manipulated for washing the surface 5 when the surface 5 is not within immediate reach. Preferably, the handle attachment means 120 is pivotally engaged with the cap 60 so that the handle 130 may be moved from a first position 140, with the handle 130 relatively parallel to the planes of each of the layers 10, to a second position 150 where the handle 130 forms an acute angle with the planes of each of the layers 10 (FIG. 5). The cap 60 has a pair of parallel slots 160 separated by a stiffening web 170, and the handle attachment means has a pair of parallel tangs 180 defining a separating gap 190 between the pair of tangs 180 (FIG. 4). The tangs 180 are pivotally supported in the slots 160 and the stiffening web 170 is engaged in the gap 190, such that the handle attachment means 120 is able to pivot with the tangs 180 moving within the slots 160. The stiffening web 170 prevents lateral motion of the handle attachment means 120 with respect to the cap 60. Preferably, the handle 130 has a proximal gripping means 210 and a distal gripping means 220 (FIG. 2), and is manufactured from wood or other suitable rigid material. Preferably, the stark 20 of layers 10 further includes at least one water absorbing layer 200 positioned between the top washing layer 70 and the cap 60. Each water absorbing layer 200 is capable of absorbing further water and soap in addition to the water and soap absorbed by the washing layers 10. Moreover, each water absorbing layer 200 further increases the rigidity of the stack 20 of layers 10 for improved contact between the washing layers 10 and the surface 5. Preferably, each water absorbing layer 200 is made from a fine fibrous material that is an effective water absorbing material and is somewhat rigid.

In operation, the layers 10 are soaked with water and soap and the apparatus is then moved on the surface 5. Such motion may be a circular pattern or a linear back and forth motion, each type of motion being extremely effective for causing scrubbing action. Pressure on the cap 60 forces the stack 20 of layers 10 against the surface 5, thereby producing a lifting and falling motion of each of the fingers 50. Each finger 50 presents edges 100 to the surface 5, causing efficient scrubbing action for removal of soils on the surface 5 (FIG. 2), even if surface 5 is a contoured surface such as that of automotive grillwork or tire covers.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. An mop apparatus comprising:

a plurality of water absorbing flexible layers positioned and arranged as a vertical stack, each of the layers having a surface area with a central portion positioned generally at the center of the surface area of each of the layers, and a peripheral portion making up the remainder of each of the layers;

a means for binding the layers together at the central portions of each of the layers to form an integral assembly, the peripheral portions being free to flexibly move in a waving or flopping motion when the assembly is shaken;

each of the layers being made-up of an intermixed combination of a viscose material, approximately 30%±25%, and synthetic fibers, approximately 70%±25%, in a density of approximately 400 grams per square meter.

2. The apparatus of claim 1 wherein each of the layers is approximately 2.6±25% mm in thickness.

3. The apparatus of claim 2 wherein the viscose material and the synthetic fibers are bound together so as to have a tear resistance of at least 100N longitudinally, and at least 90N crosswise.

4. The apparatus of claim 3 wherein the viscose material and the synthetic fibers are bound together so as to have a total water absorption of at least 550% of the weight of the layers.

5. The apparatus of claim 4 wherein the viscose material and the synthetic fibers are bound together so as to have a water absorption rate of at least 1.5 mm per second.

6. The apparatus of claim 4 wherein the viscose material and the synthetic fibers are bound together so that the bending stiffness of each of the layers is at least 1.0N in a standard bending test defined by DIN standard 53 857.

7. The apparatus of claim 1 wherein the layers are graduated in size with the smallest sized layer being on the bottom of the stack.

8. The apparatus of claim 7 wherein the peripheral portions of each of the layers includes a plurality of spaced apart radial cuts into each of the layers, the cuts being staggered from one layer to the next.

9. The apparatus of claim 1 wherein the synthetic fiber is taken singly or in combination from the group of fibers comprising polyester, polypropylene and polyethylene fibers.

10. The apparatus of claim 1 wherein the binding means includes a cap engaged with an elongate handle attached thereto for manual manipulation of the apparatus.

11. The apparatus of claim 1 further including at least one water absorbing layer positioned between the layers and the cap.

* * * * *